US007005937B2

(12) United States Patent
Lingel

(10) Patent No.: US 7,005,937 B2
(45) Date of Patent: Feb. 28, 2006

(54) CIRCULATOR AND METHOD OF MANUFACTURE

(76) Inventor: Thomas Lingel, 103 Town House Cir., Fayetteville, NY (US) 13066

( * ) Notice: Subject to any disclaimer, the term of this patent is extended or adjusted under 35 U.S.C. 154(b) by 138 days.

(21) Appl. No.: 10/445,766

(22) Filed: May 27, 2003

(65) Prior Publication Data

US 2004/0000958 A1 Jan. 1, 2004

Related U.S. Application Data

(63) Continuation-in-part of application No. 09/757,166, filed on Jan. 10, 2001, now abandoned.

(60) Provisional application No. 60/242,958, filed on Oct. 24, 2000.

(51) Int. Cl.
*H01P 1/387* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 3,739,302 A * 6/1973 McManus ..... 333/1.1
H1408 H * 1/1995 Babbitt et al. ..... 333/1.1
5,416,454 A * 5/1995 McVeety ..... 333/204

FOREIGN PATENT DOCUMENTS

JP 08204408 A * 8/1996

* cited by examiner

*Primary Examiner*—Stephen E. Jones
(74) *Attorney, Agent, or Firm*—Robert J. Sinnema; Bond, Schoeneck & King, PLLC

(57) ABSTRACT

A method of manufacturing a circulator comprising the steps of providing a central substrate layer with at least one cut-out section and circuit lines. Next, providing a magnet placed within said cut-out section and a ferrite placed on each side of said substrate layer. A steel plate is placed on each side of the substrate layer. Spacer layers are provided on each side of the substrate layer. Another shim layer is placed on each side of the central substrate layer. Laminate sheets are placed between the substrate layer, the spacer layers, and the outer shim layers. Holes are drilled through each of the substrate, the spacer layers, the outer shims, and the laminate sheets. Heat and pressure are provided to cause the laminate sheets to flow in order to join the substrate, magnets, ferrites, steel plates, spacer layers and outer shim layers into a unitary structure. Finally the structure is plated.

17 Claims, 4 Drawing Sheets

CIRCULATOR AND METHOD OF MANUFACTURE

BACKGROUND OF THE INVENTION

This application is a continuation in part of co-pending U.S. application Ser. No. 09/757,166, filed on Jan. 10, 2001, now abandoned which claims priority from the U.S. Provisional Patent Application No. 60,242,958 to Lingel et al. filed on Oct. 24, 2000.

This invention relates generally to circulators that can be implemented in surface mount packages and particularly to a circulator that can be fabricated in a package whose shape can be selected to conform to the requirements of a microwave circuit whose arrangement is affected by other constraints. In the production of microwave circuits the use of components that are mounted on tape reels greatly increases the speed and efficiency of production, for example in so-called pick and place automated production line.

A circulator is a device having several ports for electrical communication with other devices in which energy entering the device through one of the ports is transmitted to a port that is adjacent to the first port. Circulators have been used for many years in coupling microwave energy transmitted in waveguides. There are several circulators known in the prior art that utilize stripline microwave transmission lines. For example, U.S. Pat. No. 4,276,522 to Coerver describes a circulator in a stripline microwave transmission line circuit Additionally, there are known various methods of forming stripline circuit components. Most notably, U.S. Pat. No. 4,821,007 describes a method of manufacturing a strip line circuit component that has particular advantages in packaging components to be soldered directly to conventional circuit boards. The assignee of the present application is also the assignee of U.S. Pat. No. 4,821,007 which is incorporated herein by reference.

To date, there has not been a suitable and cost-effective circulator for use in automated manufacturing, particularly for use in reflow operations. Indeed, there is a need for a circulator that can be packaged in component form and soldered directly to conventional circuit boards. Preferably, the component form is one that allows for supplying the components to the end-user in a tape and reel thereby allowing for quick and efficient production of the circuit boards. It is also desirable to provide a circulator package that can be soldered to circuit board in such fashion to allow for visual inspection of the solder joints.

SUMMARY OF INVENTION

It is an object of the present invention to provide a circulator that is suitable for use in automated production of microwave circuits, specifically reflow operations.

It is another object of the present invention to provide a method of manufacturing a circulator that is suitable for automated production of microwave circuits.

It is still another object of the present invention to provide a surface mount circulator that includes a flat mounting surface.

It is yet another object of the present invention to provide a surface mount circulator that can be soldered in place on a circuit board whereby the circulator solder joints can be visually inspected.

These and other objects are obtained by a method of manufacturing a circulator comprising the steps of providing a central substrate layer with at least one cut-out section and circuit lines. Next, providing a magnet placed within said cut-out section and a ferrite placed on each side of said substrate layer. A steel plate is placed on each side of the substrate layer. Spacer layers are provided on each side of the substrate layer. An outer shim layer is placed on each side of the central substrate layer. Laminate sheets are placed between the substrate layer, the spacer layers, and the outer shims layers. Holes are drilled through each of the substrate, the spacer layers, the outer shims, and the laminate sheets. Heat and pressure are provided to cause the laminate sheets to flow in order to join the substrate, magnets, ferrites, steel plates, spacer layers and outer shim layers into a unitary structure. Finally, the structure is plated.

BRIEF DESCRIPTION OF THE DRAWINGS

FIG. 1(*b*) is an elevated three-dimensional ghost view of a surface mountable circulator.

FIG. 4A is an exploded view of a surface mount circulator embodying the present invention, and FIG. 4B is a close-up view of the central substrate of the present invention.

DETAILED DESCRIPTION OF THE PREFERRED EMBODIMENT

Figure 1B:
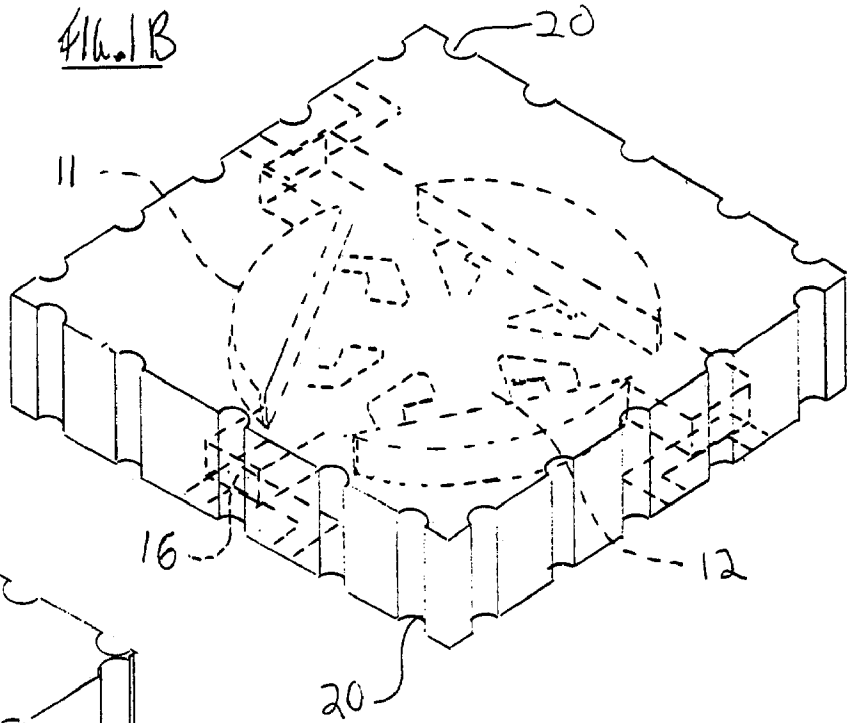
FIG. 1(*a*) is an elevated plan view of a surface mountable circulator.
Figure 1A:
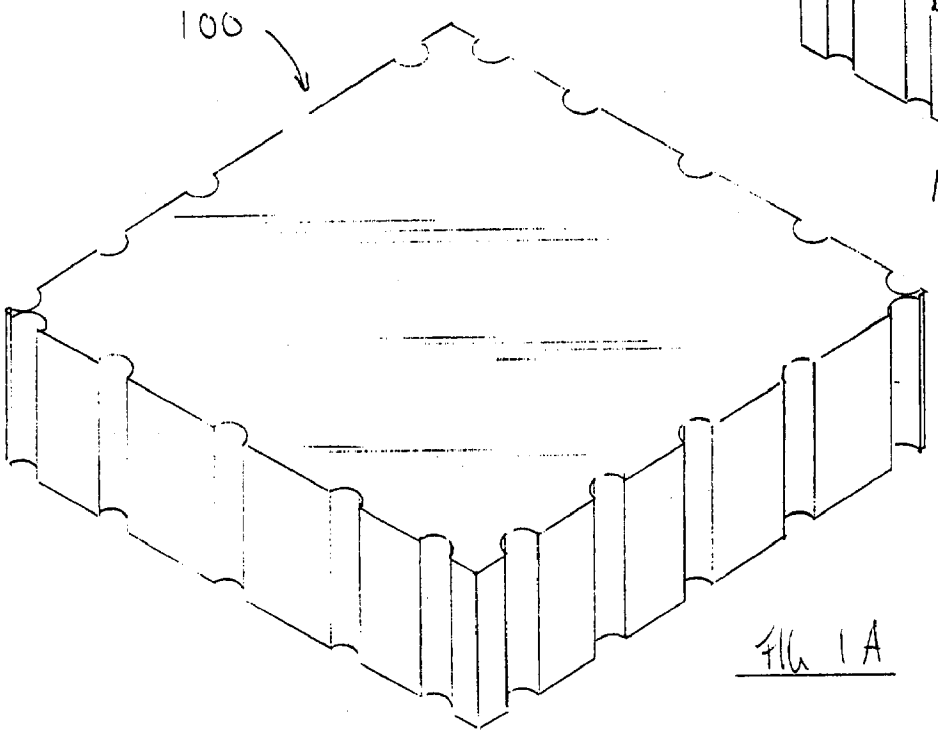

Referring now to FIG. 1A, there is shown an elevated view of the surface mount circulator 100 embodying the present invention. The overall shape of the circulator 100 is rectangular, which applicants believe is the currently preferred shape for the production of mobile cellular communications equipment. Of course, end-users of surface mount components may prefer alternative shapes, such as triangular, round or hexagonal, and one skilled in the art would recognize that the present invention could take any shape that is compatible with end-user requirements.

Referring now to FIG. 4, there are depicted the processing steps in the manufacture of the surface mount circulator that embodies the present invention. The process herein described illustrates that a plurality of circulators can be manufactured on one panel. The manufacture of a plurality of components is preferable to a single component manufacturing process because the panel production method is obviously more efficient. In the preferred method, the multiple circulators are populated on the panel and are end laminated together.

Prior to the first illustrated step of FIG. 4, the central substrate 11 has had a circuit pattern 12 laid out in ways known to those skilled in the art. For example, circuit paths 12 are depicted on circuit artwork and are used in a photolithographic process to etch patterns into the substrate 11. In addition, routers can be used to form various shapes and pathways on the substrate 11 that are selected in ways that will become more apparent in the following discussion. The substrate material is preferably polytetrafluoroethylene (PTFE), but other materials are known to those skilled in the art, such as ceramic or other plastics.

In the first step of the process of FIG. 4, the substrate has magnets 10 inserted in the previously routed cutouts. The preferred embodiment uses three magnets laid out along the circumference of the cutout as shown. Any material that has the ability to store magnetic energy can be used. As such, the magnets 10 can be in a pre-formed configuration or can be in the form of a paste or powder that can be spread or formed into the desired shape. The magnets 10 or magnetic material must be arranged so that a DC magnetic field is applied.

Next, as depicted in FIG. 4, the substrate 11 is covered with a pre-routed laminate sheet 42 with a desired dielectric characteristic in order to stack-up the structure of the circulator. Again, one skilled in the art would recognize that the laminate 42 can be constructed of various materials, such as glass reinforced hydrocarbon/ceramics. Next, ferrite 24 is placed on tope of the laminate and in between the magnets 10. Any material with gyro-magnetic characteristics can be utilized. The ferrites 24 can be pre-formed, in powder or paste form which can be spread or placed into the desired position and shape.

The next step, still referring to FIG. 4, is the addition of spacer layers 35 and additional laminate 42. The spacer layers 35 and laminate 42 are provided in order to match the height of the ferrite 24, magnets 10 and the steel plates 28 that are subsequently placed on top of the previously arranged pieces. The plates 28 are comprised of any material that is able to conduct magnetic energy, preferably steel. Of course, powders or pastes that can be spread or placed in the correct position can be used. Depending on the desired performance characteristics there can be a varying number of plates utilized.

An additional laminate sheet 42 is placed over the existing structure. This laminate sheet 42 has been pre-drilled to provide vias in order to allow electrical contact from the steel plates to an electrical ground located outside of the circulator device. An outer shim layer 40 is provided over the laminate sheet 42. The shim material is preferably PTFE. The outer shim 40 also includes vias 20 that align with the vias in the laminate sheet in order to allow for contact to an electrical ground located outside the circulator device. The outer shim material encloses the magnets 10, ferrite 24, and steel plates 28.

The process described to this point provides for the stack-up of constituents on one side of the central substrate. At this point, the part is flipped over and the steps are repeated. Specifically, a first laminate sheet is placed over the central substrate followed by the addition of the ferrite material, the spacer layers, the steel plates, the second laminate sheet and the outer shim.

After both sides of the circulator have been stacked up, the panel is placed into a lamination press for temperature and pressure treatment in order to finally form the circulator, as is well known in the art. The temperature applied to the device must be high enough to cause the laminates to flow and the pressure must be sufficient to form the circulator while taking into account the need to avoid cracking any of the constituents.

Consistent operation of circulators requires positive physical contact between the ferrite layer 24 and the steel plate 28, as well as between the ferrite layer 24 and the circuit layer 11. If a circulator lacks positive contact between these layers, air gaps are created, which affect the dielectric properties of the circulator. Further, circulators without positive contact between the ferrite 24, steel plate 28 and circuit layer 11 experience unacceptably high levels of insertion loss. In prior art circulators, the layers of the circulator are compressed together using a spring. Use of a spring to obtain compression is not practical in assembly of laminated circulator assemblies as disclosed herein. In the present invention, compression is achieved in the assembly and lamination of the circulator.

Compression of the internal components (defined as the circuit, magnet(s), ferrite(s), steel and temperature compensation disk(s)), is accomplished by the axial pressure applied to the units during the lamination process and z-axis Coefficient of Thermal Expansion (CTE) difference between the internal components and the packaging materials (defined as dielectric board material and bonding film).

The standard technique of producing laminating surface mounted electrical devices uses uniform thickness components to produce a uniform thickness finished device: all layers are formed to uniform thickness prior to lamination or bonding layers (such as heat-flowable dielectric or bond-ply) are interposed between non-uniform layers so that the resulting laminated product is uniform in thickness. As disclosed herein, however, the internal components are selected such that the nominal height of the internal components is slightly greater than the nominal height of the packaging materials to ensure maximum pressure is applied to them to prevent the flow of the bonding film between the individual internal components. This results in height variations throughout the panel between the center of the units where the internal components are located and the perimeter of the unit packaging.

During lamination of the assembly, a pressure distribution pad is placed between the top of the assembly and the upper press platen. This applies even pressure to the entire panel surface (high and low areas). At this point both the internal components and the surrounding packaging are under equal pressure. After pressure is applied, heat is applied, causing the bonding film to flow and fill all gaps. (If the pressure was not applied before the heat, the bonding film would flow between the internal components separating them and resulting in a non-functional unit.) Throughout the lamination process, pressure is maintained at a constant value.

Because the packaging materials have a higher CTE than the internal components, as the temperature decreases, the packaging materials decrease in thickness more per unit thickness than do the internal components. This results in the internal components being under a compressive load and the packaging under a tensile load. In this way, adequate compression of the internal components is achieved without use of a spring. The packaging materials and internal components must be selected such that the compressive force on the internal components does not exceed the z-axis tensile yield strength of the packaging materials or failure will occur.

After the lamination process is complete, several holes are drilled through the panel in order to form vias 20 or through-holes. After the lamination process, the device is plated with a copper plating solution and then with a tin-alloy. Finally, the panel is singulated to provide individual components in the desired shape, preferably rectangular. The singulation is known to those skilled in the art in order to arrive at a particular size and shape product. In addition, the singulation process bisects some of the holes thereby forming semicircular indentations along the periphery of each device. Three of the indentations form input/output ports and the remaining indentations are used as soldering sites for the end-user products. This surface mounting technique is of particular advantage because the end user can perform quality assurance checks of the port connections and solder sites using a direct line of sight inspection technique due to the unique configuration of the circulator.

Figure 2:
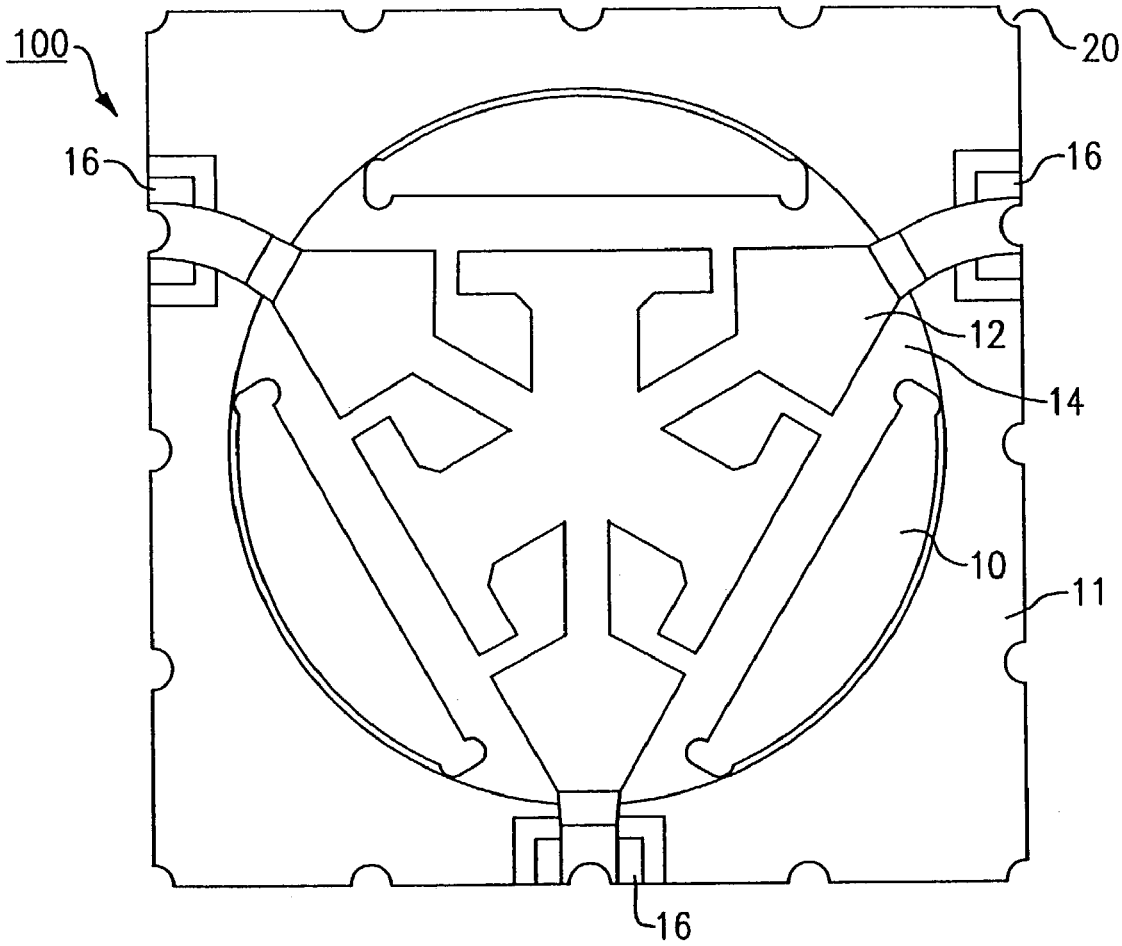
FIG. 2 is a horizontal cross-sectional view of a surface mountable circulator.

Referring now to FIG. 2, there is shown a horizontal cross-sectional view of the surface mount circulator 100 embodying the present invention. The cross section is taken through the mid-line of the circulator device 100. The circulator 100 is comprised of a substrate 11 that is manufactured from PTFE, or other similar materials as described above. The substrate 11 has a cutout 14 that is formed through the use of routers as is known in the art. Magnets 10 are placed around the periphery of the circular cutout 14. As mentioned in the discussion above, the magnetic field that is required to be created in order for the circulator to operate correctly can be created by conventional magnets or by other materials such as pastes or powders, so long as the materials have the necessary magnetic properties. In addition, although the preferred embodiment includes a magnet, a specialized application does exist for 'below resonance' circulators wherein the circulator can be formed without a magnet.

The magnets 10 create a magnetic field biasing the ferrite material around the conductor lines 12 that have been previously etched or photolithographed onto the substrate 11 as described above. Of course, the conductor lines 12 may assume various shapes and geometric configurations without departing from the scope and spirit of the present invention. The conductor lines 12 are in electrical communication with input/output ports 16 that are formed along the periphery of the circulator 100 by the drilled holes 20 and the singulation process described above wherein the holes 20 are bisected. There are also drilled holes 20 that are placed at various locations about the circulator 100 that provide for an electrical connection from the steel plates 28 to ground (not shown).

Figure 3:
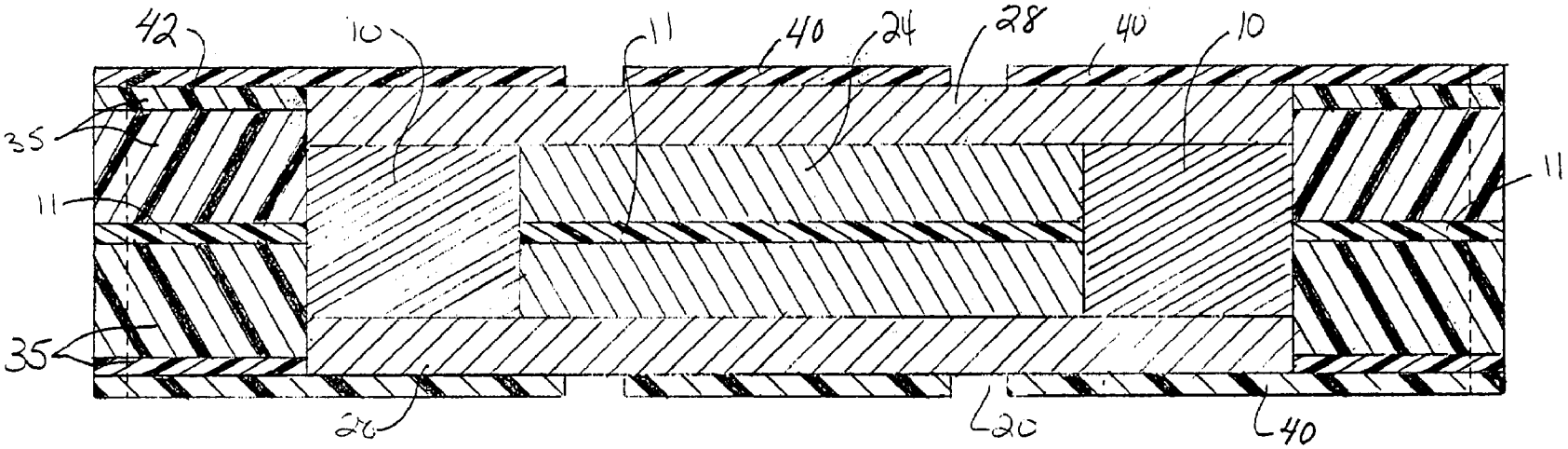
FIG. 3 is a vertical cross-sectional view of a surface mountable circulator.
Figures 9A, 9B:
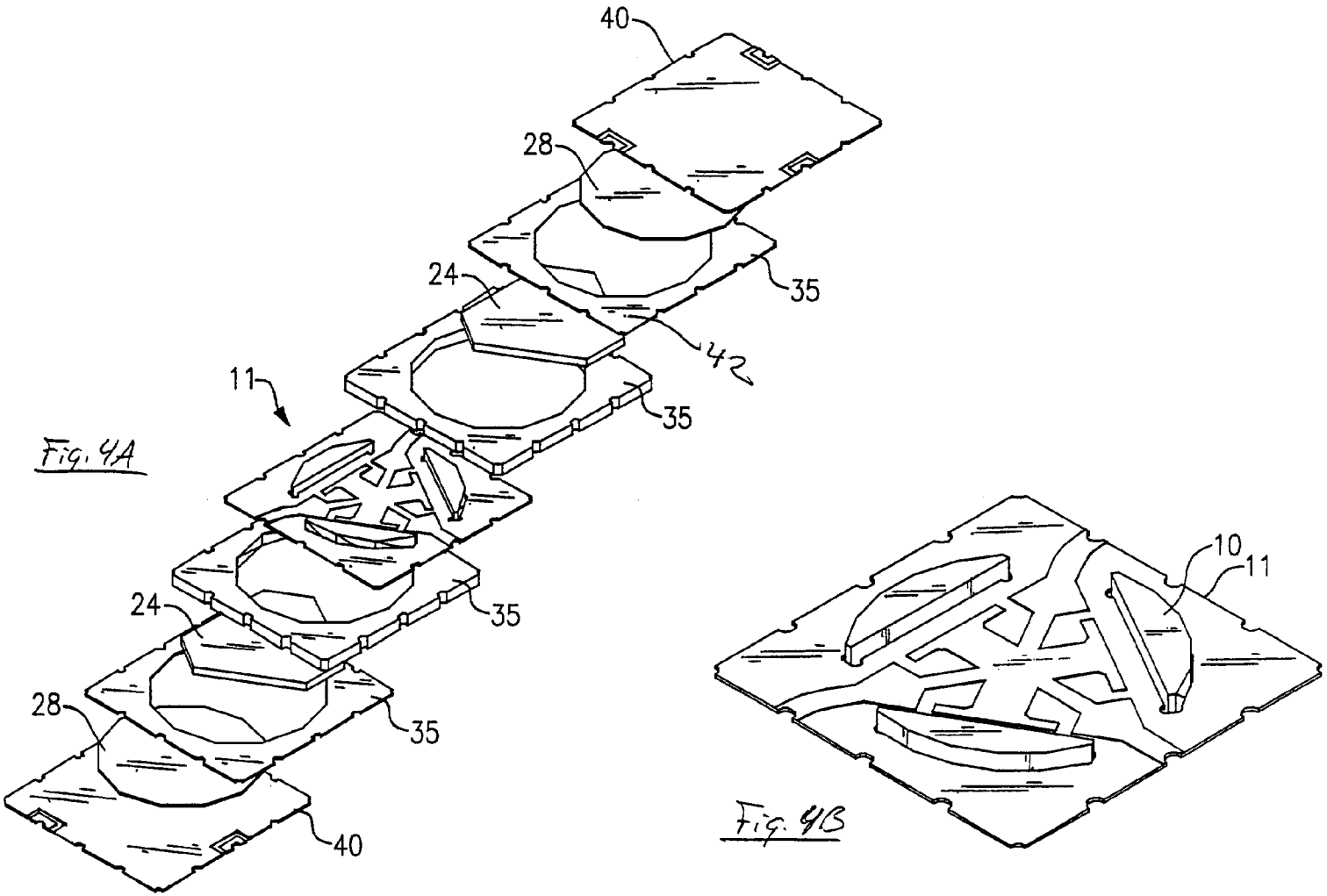

Referring now to FIGS. 3 and 4, the substrate 11 that has been pre-cut as described above accommodates the magnets 10. The layers 35 of PTFE that are used to stack-up the circulator 100 as described above are also cut out to accommodate the magnets 10, the ferrite 24 and the steel plates 28. The outer shim 40 contains holes or vias 20 to the steel plates 28 to provide an electrical contact to ground (not shown). There are laminar sheets 42 located between each of the layers 35 and the substrate 11 as described above. In some instances, temperature compensation plates (not shown) can be added to the circulator 100. The compensation plates are preferably a nickel-steel alloy. As noted above, after the stack-up and the lamination processes have been completed the circulator 100 is plated, preferably with a tin alloy solution.

It is apparent those skilled in the art that the invention can be modified in arrangement and detail without departing form the scope and spirit of the following claims and equivalents thereof. For instance, one skilled in the art would recognize that the circulator could easily be modified to act as an isolator by merely supplying a termination at an output port.

What is claimed is:

1. A surface mount circulator comprising:

a laminar assembly having a transmission line conductor interposed between at least two insulating layers, the outer surface of each said insulating layer being metallized and said line conductor having at least two co-planar axes of symmetry, said line conductor further having at least three ports;

said ports formed by a plurality of holes through said laminar assembly, each of said plurality of holes being positioned within said insulating regions and passing through said transmission line conductor;

a ferrite positioned in proximity to said transmission line conductor;

said plurality of holes being plated through with a conductive material, said conductive material in said plurality of holes being in electrical contact with said transmission line conductor and insulated from said metallization on said outer surfaces of said insulating layers;

electrical contact pads formed by bisecting said plurality of holes, said plurality of bisected holes forming electrical contact pads with said transmission line conductor, said electrical contact pads forming low loss transition couplings at each of said locations where said transmission line conductor intersects said axes of symmetry of said transmission line conductor; and wherein the materials of said laminar assembly are selected such that there is a difference in coefficient of thermal expansion that causes said laminar assembly to exert axial pressure to bias said ferrite and said line conductor together.

2. The circulator of claim 1 wherein said ferrite is positioned in an inlay, said inlay formed on an interior side of one of said insulating layers.

3. The circulator of claim 1 further comprising:

a magnetic means positioned such that a magnetic field is applied through said ferrite.

4. The circulator of claim 3 wherein said ferrite is positioned in an inlay, said inlay formed on an interior side of one of said insulating layers.

5. The circulator of claim 3 wherein said magnetic means comprises a permanent magnet.

6. The circulator of claim 5 wherein said ferrite is positioned in an inlay, said inlay formed on an interior side of one of said insulating layers.

7. The circulator of claim 5 wherein said magnet is placed in an inlay formed on an interior side of at least one of said insulating layers.

8. The circulator of claim 7 wherein said ferrite is positioned in an inlay, said inlay formed on an interior side of one of said insulating layers.

9. The circulator of claim 5 wherein said magnet is placed external to said laminate assembly.

10. The circulator of claim 9 wherein said ferrite is positioned in an inlay said inlay formed on an interior side of one of said insulating layers.

11. The circulator of claim 3 wherein said magnetic means comprises magnetic material selected from the group consisting of magnetic paste and magnetic powder.

12. The circulator of claim 11 wherein said ferrite is positioned in an inlay, said inlay formed on an interior side of one of said insulating layers.

13. The circulator of claim 11 wherein said magnetic means is placed in an inlay formed on an interior side of at least one of said insulating layers.

14. The circulator of claim 13 wherein said ferrite is positioned in an inlay, said inlay formed on an interior side of one of said insulating layers.

15. The circulator of claim 3 further comprising:

a steel plate positioned between said ferrite and at least one of said insulating layers.

16. The circulator of claim 15 wherein said transmission line conductor, said ferrite, said magnetic means and said steel plate are maintained in a compressed state without use of a spring.

17. A surface mount circulator comprising:

a laminar assembly having a transmission line conductor interposed between at least two insulating layers, the outer surface of each said insulating layer being metallized and said line conductor having at least two co-planar axes of symmetry, said line conductor further having at least three ports;

said ports formed by a first plurality of holes through said laminar assembly, each of said first plurality of holes being positioned within said insulating regions and passing through said transmission line conductor;

a second plurality of holes through at least one of said insulating layers positioned on said axes of symmetry of said transmission line conductor;

a ferrite placed in proximity to said transmission line conductor;

a steel plate positioned between said ferrite and at least one of said insulating layers;

said first and second plurality of holes being plated through with a conductive material, said conductive material in said first plurality of holes being in electrical contact with said transmission line conductor and insulated from said metallization on said outer surfaces of said insulating layers and said second plurality of holes being in contact with said metallization on said outer surfaces of said insulating layers to provide an electrical contact path between said metallizations;

electrical contact pads formed by bisecting said plurality of holes, said plurality of bisected holes forming electrical contact pads with said transmission line conductor, said electrical contact pads forming low loss transition couplings at each of said locations where said transmission line conductor intersects said axes of symmetry of said transmission line conductor; and wherein the materials of said laminar assembly are selected such that there is a difference in coefficient of thermal expansion that causes said laminar assembly to exert axial pressure to bias said ferrite and said line conductor together.

* * * * *

UNITED STATES PATENT AND TRADEMARK OFFICE

CERTIFICATE OF CORRECTION

PATENT NO. : 7,005,937 B2
APPLICATION NO. : 10/445766
DATED : February 28, 2006
INVENTOR(S) : Thomas Lingel It is certified that error appears in the above-identified patent and that said Letters Patent is hereby corrected as shown below:

Title Page:

Section [75], Please add; Niels H. Kirkeby and Thomas Almholt

Signed and Sealed this

Seventh Day of July, 2009

JOHN DOLL
*Acting Director of the United States Patent and Trademark Office*